US012478157B2

(12) United States Patent
McKinley

(10) Patent No.: US 12,478,157 B2
(45) Date of Patent: Nov. 25, 2025

(54) SHADE HOLDER

(71) Applicant: Lance D. McKinley, Creve Coeur, MO (US)

(72) Inventor: Lance D. McKinley, Creve Coeur, MO (US)

( * ) Notice: Subject to any disclaimer, the term of this patent is extended or adjusted under 35 U.S.C. 154(b) by 89 days.

(21) Appl. No.: 18/510,348

(22) Filed: Nov. 15, 2023

(65) Prior Publication Data

US 2024/0156227 A1 May 16, 2024

Related U.S. Application Data

(60) Provisional application No. 63/425,613, filed on Nov. 15, 2022.

(51) Int. Cl.

| | |
|---|---|
| ***A45C 11/24*** | (2006.01) |
| ***A45C 11/00*** | (2006.01) |
| ***A45C 13/00*** | (2006.01) |
| ***A45C 13/02*** | (2006.01) |
| ***A47G 23/02*** | (2006.01) |

(52) U.S. Cl.

CPC ..... *A45C 11/24* (2013.01); *A45C 13/005* (2013.01); *A45C 13/02* (2013.01); *A47G 23/0216* (2013.01); *A45C 11/002* (2025.01)

(58) Field of Classification Search

CPC ..... A45C 11/24; A45C 13/005; A45C 13/02; A45C 11/002; A47G 23/0216

USPC ..... 206/217, 320

See application file for complete search history.

(56) References Cited

U.S. PATENT DOCUMENTS

| | | | | | |
|---|---|---|---|---|---|
| 5,058,757 | A * | 10/1991 | Proa | B65D 81/3886 | 220/739 |
| 5,186,196 | A * | 2/1993 | Gorka | A45B 11/00 | 206/217 |
| 8,459,494 | B2 * | 6/2013 | Dewinetz | A47G 23/00 | 206/217 |
| D772,657 | S * | 11/2016 | Kohn, Jr. | D7/624.2 | |
| D1,011,142 | S * | 1/2024 | Howerton | D7/619.1 | |
| 2016/0227663 | A1 * | 8/2016 | Holmes | A45C 11/00 | |
| 2019/0097669 | A1 * | 3/2019 | Zaccaria | H04M 1/21 | |
| 2019/0218813 | A1 * | 7/2019 | Nelson | E04H 15/38 | |
| 2022/0098894 | A1 * | 3/2022 | Corcoran | E04H 15/44 | |
| 2024/0393826 | A1 * | 11/2024 | Hewett | A45C 11/003 | |

* cited by examiner

*Primary Examiner* — Chun Hoi Cheung
(74) *Attorney, Agent, or Firm* — Charles McCloskey

(57) ABSTRACT

A shade holder device has a base, a column upon the base offset from the center of the base, and a shade connecting to the column spaced above the base. The shade its own width greater than the base for casting the base into a shadow. The column has a compartment within that receives a smartphone and a door upon the compartment that covers it. The column connects to the base upon a bench having drain holes. The base also has a plate with drain holes spaced around its perimeter and the plate spaced above the bottom of the invention when assembled. The base, the column, and the shade connect in only one way. The present invention receives smartphones that do not fold and of width and height less than that of the compartment.

10 Claims, 3 Drawing Sheets

SHADE HOLDER

CROSS-REFERENCE TO RELATED APPLICATION

This non-provisional application claims priority to the provisional application Ser. No. 63/425,613 filed on Nov. 15, 2022 and all applications are owned by the same inventor.

BACKGROUND OF THE INVENTION

The present invention relates generally to housewares and more particularly to a device that holds a drink, shades the drink, and holds a smart phone simultaneously.

Nature has called people to the water for eons. Water means life to people. Early settlements of people had locations near water, whether freshwater or saltwater. From settlements people sought their food nearby often grown with water, that drank water, or that swam in water. People though faced and still have a profound disadvantage with water: limited swimming ability.

But people still enjoy being around water regardless of swimming. People socialize around pools, swimming holes, beaches, lakesides, and the like across the country. Often socializing includes consuming beverages of all kinds. Some people consume a beverage at once, while others sip their beverage little by little. Sipped beverages often have an open cup, open glass, or an open bottle held by a person. But the person may tire of holding it or get invited to swim. The person then places the cup, glass, or bottle on a surface. On a surface, the beverage in its container may tip over, have bugs fly into it, or water splash in, among other hazards. A surface includes a dock with its flat deck adjacent to a water feature, such as an ocean, river, lake, or stream.

These days, people socialize and keep their smart phones on their person or nearby. Newer smart phones claim water resistance while older ones have no hope if immersed in a swimming pool, a lake, an ocean, or other water body. With replacement costs of smartphones trending higher and higher, protecting a smartphone when near water makes prudent sense. Smartphones have their temperature resistance however, avoiding water entering the smartphone prolongs its useful life. These days, a person does not want their smartphone to become a brick from mere drops of water.

DESCRIPTION OF THE PRIOR ART

For protecting drinks, people have put beverage containers, such as cups, on tables, on a pool deck, on a dock, in cup holders, on a lounge chair, on a boat seat, and the like. These locations receive the cup but generally leave the top of the cup exposed to the atmosphere and to sunlight. Cup holders and boat seats impart the risks of motion to a cup. Tables, pool decks, and docks leave a cup at risk for being tapped or kicked by an errant foot of a person. If a passing shower comes to a pool, a beach, or a lake, a cup or other beverage container resting near the water body may have rain enter the beverage. When the shower passes, the cup remains exposed to the sun and to insects buzzing nearby. Those pesky wasps have a keen hankering for carbonated sodas.

For protecting smartphones, people rely upon their construction, liners adhered to screens, select cases, password codes, and the like. These protective measures serve as a last line of defense because they install upon or around a smartphone itself. A hazard, such as water, snow, spilled beverage, hand of a thief, and the like may still contact a smartphone. Many times, the flat, elongated form of a smartphone prompts a person to lay it down on a surface. Such positioning exposes the glass to sunlight and potential damage from insects or other projectiles passing by. A smartphone placed down may also splash into a puddle or other liquid upon a surface.

The Shade Holder overcomes the above-mentioned disadvantages and drawbacks of the prior art. As such, the general purpose of the present invention, which will be described subsequently in greater detail, is to provide new and improved Shade Holder which has all the advantages of the prior art mentioned heretofore and many novel features that result in Shade Holder which are not anticipated, rendered obvious, suggested, or even implied by the prior art, either alone or in any combination thereof.

SUMMARY OF THE INVENTION

The present invention of the Shade Holder has a base, a column upon the base offset from the center of the base, and a shade connecting to the column spaced above the base. The shade its own width greater than the base for casting the base into a shadow. The column has a compartment within that receives a smartphone and a door upon the compartment that covers it. The column connects to the base upon a bench having drain holes. The base also has a plate with drain holes spaced around its perimeter and the plate spaced above the bottom of the invention when assembled. The base, the column, and the shade connect in only one way. The present invention receives smartphones that do not fold and of width and height less than that of the door.

There has thus been outlined, rather broadly, the more important features of the invention in order that the detailed description thereof that follows may be better understood and that the present contribution to the art may be better appreciated. Other attributes of the invention include shade having a socket connection to the column, shade having a flattened dome shape that sheds water, ventilation apertures in the column above the door, tabs upon the base that support a smartphone placed outside the door, and the shade and the base having spaced apart centers. Additional features of the invention will be described hereinafter, and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a shade holder that stands by itself while preventing excessive sunlight and excessive water from entering a cup placed within it.

Another object is to provide such a shade holder that stores a smart phone upright.

Another object is to provide such a shade holder that drains any water splashed upon it.

Another object is to provide such a shade holder that ventilates its compartment storing a smart phone.

Another object is to provide such a shade holder that partially conceals a smart phone in a decorative manner.

Another object is to provide such a shade holder that receives labelling.

Another object is to provide such a shade holder that may be easily and efficiently manufactured and marketed to the consuming public.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
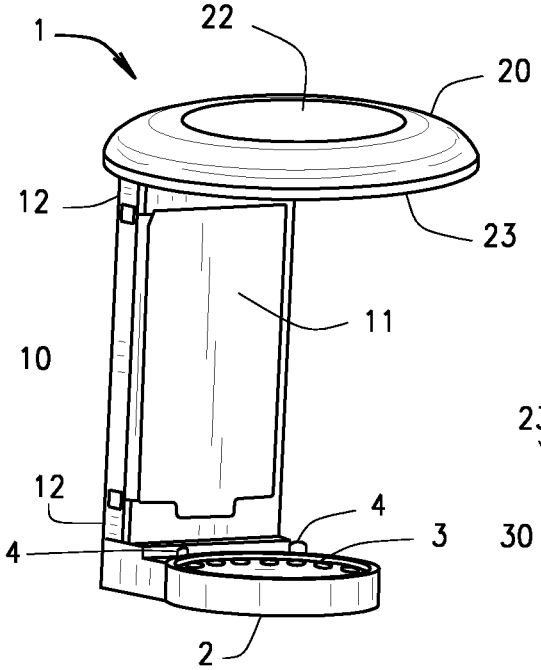
FIG. 1 shows a perspective view of the present invention.

The present invention overcomes the prior art limitations by providing a shade holder for use near a pool, beach, lake, river or other water body, on docks of all kinds, and on watercraft. FIG. 1 shows the shade holder of the invention in a perspective view. The shade holder, or invention 1, allows a user to place a container, such as a beverage glass or bottle, upon it under shade with storing a smart phone or mobile phone inside of it. The invention 1 has a rounded base 2 with a bottom that rests upon a supporting surface, not shown. The rounded portion of the base has its own diameter, and the base has a plate 3 with a plurality of drain holes 33 spaced around its perimeter. The base has a tangential bench portion of lesser width than the diameter of the base. The bench portion receives a column 10, typically hollow. Alternatively, the base is called a coaster. In a further alternate embodiment, the base has a layer beneath it that operates as a coaster to absorb moisture.

Figure 6:
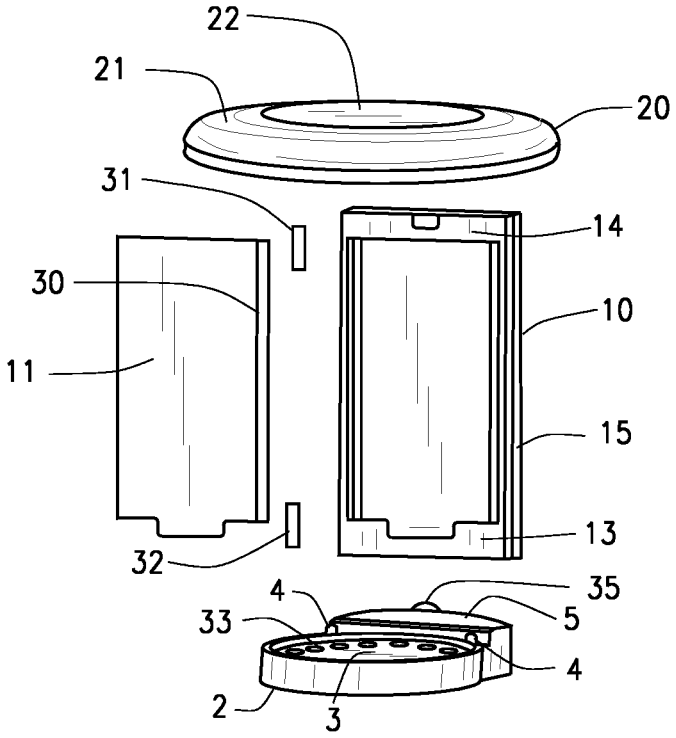
FIG. 6 describes an exploded view of the invention.

The column has an upright orientation generally perpendicular to the base 2. The column 10 has an offset position, spaced outwardly from the plate 3, and tangential to the base 2. The column has a generally rectangular form in this view with two narrow lateral ends mutually spaced apart and two longitudinal sides mutually parallel and spaced apart and perpendicular to the lateral ends. Proximate the lateral ends, each longitudinal side has two locks 12. The lower lock in the figure secures the column to the base. Between the two locks and the two longitudinal sides and in the direction of the base, the column has a door 11 in hinged connection to it. The door has at least one hinge for a hinged connection to the column, though later FIG. 6 shows two hinge pins being spaced apart. Opposite the hinges, the door has a smooth upright edge for a tight fit into an internal edge of the column. The door has a transparent material or alternatively a translucent material, or alternatively an opaque material. The door has a thin, planar form and permits a person to see a smartphone placed within the compartment. The door, when closed, prevents water and beverage splashes from reaching into the compartment. In front of the door upon the base 2, the invention has two tabs 4 spaced outward from the plate 3. These two tabs retain or grip an edge of a smartphone—not shown—placed upright and leaning upon the door.

The column shows its second lock 12 generally away from the base 2. Above the second lock, the invention has a shade 20, shown round, connecting to the column. Preferably, the shade has a mechanical connection to the column so that a person may disassemble the invention after its usage and then for storage. The shade has a generally round form with a diameter greater than the diameter of the base. The shade extends above, over, and outward from the base as shown while the shade has its own diameter greater than the diameter of the rounded portion of the base. The shade also has a somewhat convex surface with a flat, centered head 22, where the shade truncates the convex surface as shown. The head 22 receives a label, a sticker, a decal, screen print, laser etching, or another decoration for the invention. The head has a diameter at least one third of the diameter of the shade. In one embodiment, the head has a diameter of six inches. The head Opposite the head and around the shade, the shade has a rim 23 generally perpendicular to the head and parallel to the column. Alternatively, the shade is called a lid.

Figure 2:
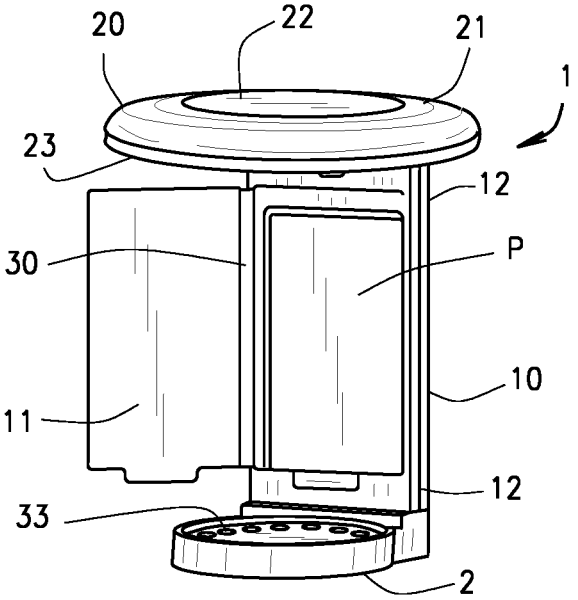
FIG. 2 provides an opposite perspective view of FIG. 1.

FIG. 2 has the shade holder 1 in an opposite perspective view from FIG. 1. The shade holder has its base 2 with the column 10 connected to it and the shade 20 upon the column and over the base. The base 2 has its rounded forward portion shown in the foreground with drain holes 33 equally spaced around the round portion of the base as later shown and described. In this figure, the column has the door 11 open and a smart phone P shown inside the column 10. The door has an inner edge 30 that operates as a hinge so that the door pivots offset, about its length. As later shown and described, the column has a chamber that receives a smart phone P. The door also has a lower tab spaced below the tab described in FIG. 1. The lower tab fits a counterpart slot in the column. Above the door and upon the center of the column, the column has at least one vent slot. This figure shows one vent slot just below the shade 20 and its connection to the column. The shade 20 has it convex shape extending upwardly and inwardly from the rim 23. The convex shape extends towards the head 22 and then the shade becomes flat for the head. Between the rim 23 and the head 22, the shade has a hill 21, denoting the convex portion of the shade. The hill has a radius of curvature that prevents ponding of water and sheds water that lands upon the invention.

Figure 3:
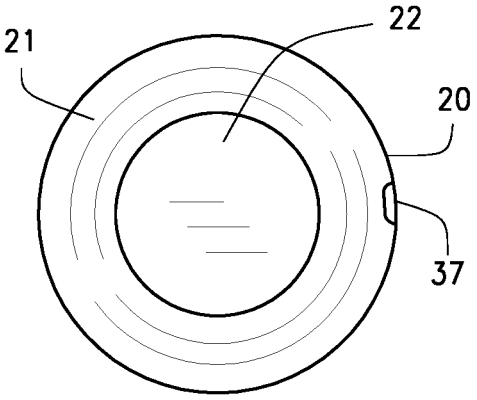
FIG. 3 describes a top view of the invention.

Turning the assembled in invention, FIG. 3 shows the invention from a top view with the shade 20 in the foreground. The shade though conceals the remainder of the invention below it, that is, into the plane of the figure. The shade 20 has its curved hill 21 here shown similar to an annulus and the head 22 flat and centered within the shade.

The head receives a label, a sticker, or other decoration and displays it perpendicular to the rim, that is, parallel to the plane of this figure. People can thus readily observe the decorated shade when the invention has its position upon a supporting surface. Towards the right of this figure in a 3 o'clock position, the shade has an indentation 37 denoting its connection to the column concealed behind the shade into the plane of the figure.

Figure 4:
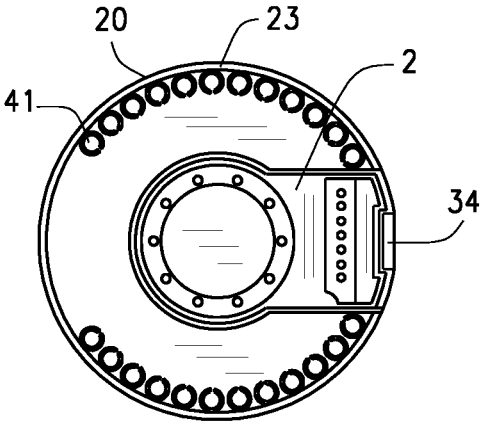
FIG. 4 illustrates a bottom view of the invention.
Figure 10:
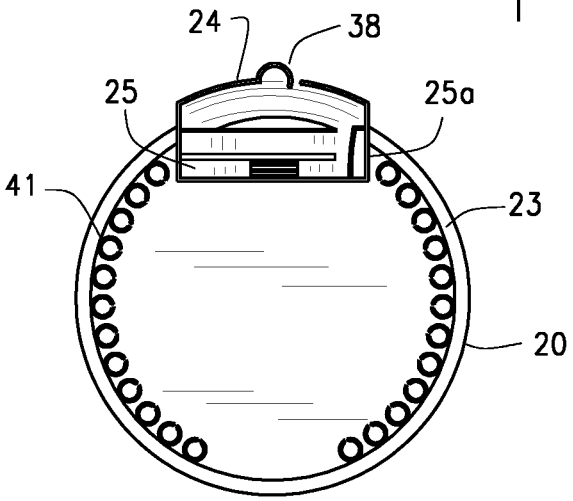
FIG. 10 shows a bottom view of the shade of the invention.

Turning the assembled invention again, that is, over, FIG. 4 provides a bottom view with the base 2 in the foreground and the shade 20 behind it. The base 2 has its round form with a somewhat rectangular bench tangential to the round form and offset from the plate. The bench appears at the edge of the shade, that is, below the rim 23 while the round form of the base extends inwardly and beneath the shade. As shown, the shade overhangs outwardly from the base. The shade has two dozen slotted cylinders 41 here shown on end with some cylinders concealed behind the base. Later FIG. 10 shows the slots lengthwise and prominently in the cylinders. The cylinders receive one bead, not shown, of a bead string. The base has its drain holes 33 as shown in the center of the figure and additional drain holes 40 beneath the shoulder 6. To the right of the base and beneath the column 10, the base has the lower portion of a tab 34 that mates with a cooperating opening in the column as later shown.

Figure 5:
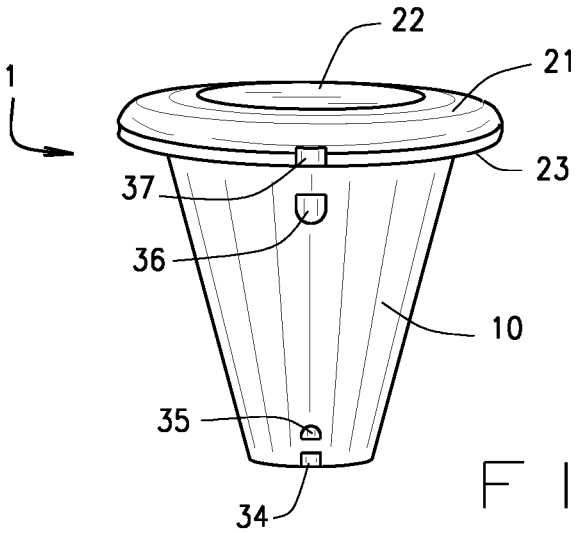
FIG. 5 shows a rear perspective view of the column of the invention.

FIG. 5 looks at the column 10 in a rear perspective view. The column has the shade upon it with the rim 23 adjacent to the column. The shade curves upwardly and into the plane of the figure through the hill 21 and flattens for the head 22, akin to FIG. 3. More particularly, the column has a curved outer edge that follows a portion of the rim. The curved outer edge has additional features that secure the base to it and the shade to it. More particularly, the column has a square like opening that admits the lower portion of a tab 34 in a tab and slot connection. The column then has a rounded opening to admit the upper portion, as at 35, of the tab, again in a tab and slot connection to serve as an alternate embodiment of lock 12. Spaced upwardly from the preceding opening, the column has a higher rounded opening that receives a rounded portion as at 36 of a second tab that extends beneath the lid 20 near the indentation 37.

FIG. 6 then shows the shade holder 1 in an exploded view showing its components. As before, the invention has its base 2 beneath the column 10 and the shade 20 upon the column. The base has its rounded form toward the reader with the plate 3 having drain holes 33 around the perimeter, preferably ten drain holes. Tangential to the rounded form, the base 2 has its bench 5 of a somewhat rectangular shape when seen on edge but having a rounded outer edge away from the plate forming the cross section of the bench. As later explained in FIG. 9, the column has its cross section that receives the bench. The bench has a cooperative cross section or shape that fits snugly within the column so that the column near the footer solely connects to the bench. The bench has a slight elevation upon the base and a rounded form outward from the. The bench cooperatively receives the column during assembly when the upper portion 35 of the tab engages a similarly spaced opening as previously shown in FIG. 5. Inwardly from the bench, the base has at least one tab, here shown as two spaced apart tabs 4 that extend upwardly from the plate. The tabs receive a smart phone positioned upright and tipped upon the door.

The column 10 has its rectangular form as shown with its lateral ends more precisely called a footer 13 proximate the bench 5 and an opposite header 14 proximate the shade 20. Into the plane of the figure from the footer 13 and the header 14, the column has its wall 15 that forms the back of the compartment that receives a smartphone, not shown. The compartment forms within the footer, the header, and the wall. The footer has its counterpart slot that receives the lower tab of the door, and the header has a centered vent slot. The column, the header, and the footer have a recess that receives the door, when closed. The door 11 has its flat planar form here with its inner edge 30 engaging with an upper pin 31 proximate the shade and a lower pin 32 proximate the base and forming two hinges shown. The inner edge has a hollow tubular form that receives the upper pin 31 and the lower pin 32 snugly. In an alternate embodiment, the door has an outward tab for a person to grasp and the lower tab that closes the bottom of the compartment.

And in this angle of view, the shade 20 has its partial convex form with the hill 21 extending upward and inward from the rim to the head 22.

Figure 7:
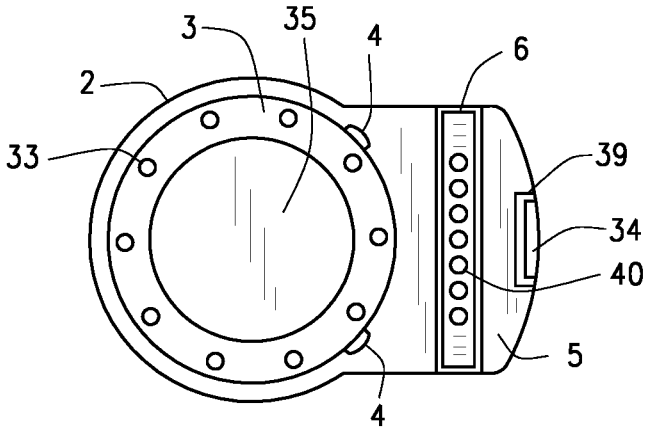
FIG. 7 shows a top view of the base of the invention.

FIG. 7 provides a top view of the base 2 as in just before assembly with the column. The base has its round plate 3 with drain holes 33 spaced around its perimeter. Preferably, the base has ten drain holes spaced as shown. Within the drain holes, the base has a round recess 42, suitable for receiving a round label, not shown. Outwardly from the plate, the base has two tabs 4 also extending upwardly from the plate, that is, towards the reader, and where the round plate merges into the elongated part of the base as shown. As before, the tabs 4 allow a phone P to rest upon them as previously shown. From the tabs, the base extends outwardly in a tangential portion that extends in a width less than that of the base's diameter. The base then becomes the bench 5 which has the width of the tangential portion but a curved outer surface, here to the right of the figure. The bench then receives the column 10 with a cooperating shape later shown in FIG. 9. The bench has its chamber 6 here shown parallel to a tangent to the base. The chamber extends into the plane of the figure for the height of the bench and of the base. The chamber also has its own drain holes 40, as shown, and preferably seven drain holes symmetrically spaced. A smart phone P may rest within the chamber. And to the right of the bench, the base has the lower part as at 34 of the tab within a slot 39.

Figure 8:
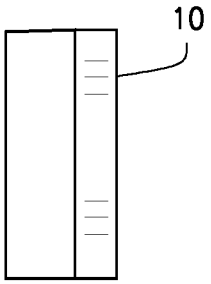
FIG. 8 provides a side view of the column of the invention.

FIG. 8 then has a side view of the column 10 with its wall 15 here shown curving out of the plane of the figure. The wall's curvature follows a portion of the rim 23 of the shade 20 upon assembly of the invention. The wall ends in flat portions as later shown in FIG. 9.

Figure 9:
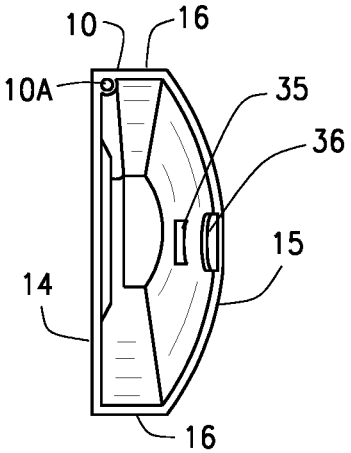
FIG. 9 provides a top view of column of the invention.

FIG. 9 then shows a top view of the column 10 showing its cross section. From the left, the column has its header 14. From the header, two mutually parallel and spaced apart sidewalls 16 extend. The sidewalls generally extend away from the base of an assembled invention. The sidewall towards the top of the figure abuts the header with a second tube 10A having an integral, round, hollow cylindrical form. The second tube aligns with the inner edge 30 of the door 11 as previously shown and described. In the embodiment with two hinge pins as in FIG. 6, the column has an additional second tube opposite the initial second tube shown so that each hinge pin fits into a second tube and the inner edge. The two second tubes share the same axis though spaced apart to receive the hinge pins. Opposite the header, the two sidewalls merge with the wall 15. As before, the wall 15 has its curvature that follows a portion of the shade. Into the plane of the figure, the column has an opening within the footer, the sidewalls 16, and the wall 15. That opening admits the column upon the bench during assembly of the invention. In the foreground of the figure, the opening defined within the header 14, the sidewalls 16, and the wall 15 connects the column to the shade as later shown and described. The sidewalls have corresponding openings as components of the lock 12 previously described.

And the opening of the header and the column of FIG. 9 fits upon the shade 20 as shown in FIG. 10 with its bottom view of the shade 20. The shade is curved into the plane of the figure and shows the lip 23 upon its perimeter. Upon the perimeter, a socket 24 merges with the rim. The socket receives the header 14 of column 10 during assembly. The socket has a rounded outer edge, two spaced apart flat lateral edges, and a flat inner edge perpendicular to the lateral edges, thus showing its cross section. Upon its rounded outer edge, the socket has a round portion as at 36 of a second tab 38 for a tab and slot connection of the shade to the column, akin to the base to the column as well. The round portion as at 36 of a second tab 38 serves as an alternate embodiment of lock 12. Here, the column near the header solely connects to the socket. The socket steps out in width, as at 25, with the three vent slots shown stacked in the figure. The socket has one lateral edge shown to the right in this figure that approaches the flat lateral and forms a notch 25*a* that extends from the lid as at the step out in width to the edge of the socket towards the reader. The notch 25*a* receives a second tube 10*a* from the top, or upper part, of the column during assembly. The socket 24 effectively operates as a male connector that fits within the column as a female connector. The socket fits inward of the header of the assembled invention. As explained above, the column has its cross section that receives the socket. The socket, much like the bench, has a cooperative cross section or shape that fits snugly within the column. The socket 24 has at least one component of the lock 12 upon its lateral edges. The socket fits into the wall behind the header, and the column then connects around the bench 5 to assemble the invention. The curved shapes of the bench, the wall, and the socket cooperatively guide a person to assemble the invention one way only, with the shade extending well over the base. The column connects to the bench and then it connects to the shade, so the shade overhangs beyond the base. Also, the shade beneath the head 22 and proximate the rim 23 has two groups of slotted cylinders 41 as shown. Each group of slotted cylinders has twelve equally spaced outwardly from the shoulder 24 and following the rim 23 but leaving a gap opposite the shoulder. Each cylinder has a slot extending into the plane of the figure from the rim 23 in the foreground to the shade where its hill 21 commences. The slots in the cylinders are perpendicular to the plane of the figure. Effectively, the slots each extend for the full height of the cylinder. A slot allows a user of the invention to insert one bead of a string of beads into the open end of the cylinder. In the event a bead jams into the cylinder, the slot allows a user to gently pry the cylinder slightly more open to release the bead.

From the aforementioned description, a shade holder has been described. The shade holder device is uniquely capable of shading a base with a drink upon it and holding a smart phone placed within the invention and with the invention placed upon a supporting surface. In time, a user of the invention should move it. To do so, the user recalls that the column releasably connected to the bench and the column. The user then press the portions of the tabs in the openings of the wall so that the bench falls, and the column drops from the shade under gravity. The shade holder and its various components may be manufactured from many materials, including but not limited to, vinyl, polymers, such as nylon, polypropylene, polyvinyl chloride, high density polyethylene, polypropylene, ferrous and non-ferrous metals, their alloys, foils, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such to as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A device for holding a beverage container and a smart phone under shade, comprising:

a transparent door hingedly connecting to a hollow column, said column having a header, a spaced apart footer, and a wall spanning between said header and said footer, said door spanning from said header to said footer;

said column beneath said footer connecting to a rounded base having a diameter and a plate with a perimeter and drain holes about said perimeter;

said column beneath above said header connecting to a round shade, said shade having a diameter greater than that of said base, and said shade extending over and outward from said base;

wherein said column is adapted to receive a smart phone; and wherein said base is adapted to support a container placed thereon.

2. The device for holding a beverage container and a smart phone under shade of claim 1 further comprising:

said door having an inner edge formed of a tube upon which said door rotates;

at least one hinge pin engaging said inner edge;

said cross section of said column having two mutually parallel and spaced apart sidewalls, said header spanning between said sidewalls, a wall having a curve spaced apart from said sidewalls; and a second tube positioning where said header intersects one of said sidewalls and an additional second tube positioning where said footer intersects one of said sidewalls, said second tubes being mutually coaxial and each receiving said at least one hinge pin.

3. The device for holding a beverage container and a smart phone under shade of claim 2 further comprising:

a rounded base having a diameter, a plate with a perimeter, drain holes about said perimeter, and a recess centered within said plate, said recess is adapted to receive one of a label, a sticker, and a decoration;

said base having two spaced apart tabs outward of said plate proximate said column, wherein each of said tabs is adapted to retain a smart phone;

said base having a bench of a cooperative shape to the cross section of said column, said bench being offset from said plate and parallel to a tangent upon said plate;

a round shade connecting to said column, said shade having a diameter greater than that of said base, and a socket of a cooperative shape to the cross section of said column, and said shade extending over and outward from said base, wherein said column connects to said bench and said column then connects to said socket thus said shade overhangs beyond said base; and said socket of said shade having a notch, said notch admitting said additional second tube proximate said header.

4. The device for holding a beverage container and a smart phone under shade of claim 3 further comprising:

two hinge pins, each hinge pin spacing apart from the other coaxially and engaging one of said second tubes.

5. The device for holding a beverage container and a smart phone under shade of claim 4 further comprising:

said bench having a tab outwardly from said plate with a lower portion and an upper portion engaging corresponding openings in said wall of said column opposite said footer;

said socket having a tab towards said with a lower portion and an upper portion engaging corresponding openings in said wall of said column opposite said header; and wherein said column releasably connects to said bench and to said column.

6. The device for holding a beverage container and a smart phone under shade of claim 5 further comprising:

said column having a compartment therein within said footer, said header, and said wall, said compartment is adapted to receive a smart phone;

said column proximate said footer solely connecting to said bench;

said column proximate said header solely connecting to said socket; and wherein said device is adapted to a user assembling it one way only.

7. The device for holding a beverage container and a smart phone under shade of claim 6 further comprising:

said shade having a truncated convex shape extending from a rim inwardly and upwardly from said rim to a flat head centered upon said shade;

said truncated convex shape of said shade forming a hill spanning from said rim to said head;

a plurality of slotted cylinders depending from said hill and inward from said rim, each of said slotted cylinders having a lengthwise slot, and wherein each of said slotted cylinders is adapted to receive a bead from a bead string; and wherein said head is adapted to receive one of a label, a sticker, and a decoration.

8. The device for holding a beverage container and a smart phone under shade of claim 7 wherein said plurality of slotted cylinders Incudes twenty four.

9. A device for holding a beverage container and a smart phone under shade, comprising:

a door hingedly connecting to a hollow column, said column having a header, a spaced apart footer, and a wall spanning between said header and said footer, said door spanning from said header to said footer;

said column beneath said footer connecting to a rounded base having a diameter and a plate with a perimeter and drain holes about said perimeter;

said column beneath above said header connecting to a round shade, said shade having a diameter greater than that of said base, and said shade extending over and outward from said base;

wherein said column is adapted to receive a smart phone;

wherein said base is adapted to support a container placed thereon;

said door having an inner edge formed of a tube upon which said door rotates;

two hinge pins engaging said inner edge, each hinge pin spacing apart from the other coaxially;

said cross section of said column having two mutually parallel and spaced apart sidewalls, said header spanning between said sidewalls, a wall having a curve spaced apart from said sidewalls;

a second tube positioning where said header intersects one of said sidewalls and an another second tube positioning where said footer intersects one of said sidewalls, said second tubes being mutually coaxial and each receiving one of said hinge pins;

a rounded base having a diameter, a plate with a perimeter, drain holes about said perimeter, and a recess centered within said plate, said recess is adapted to receive one of a label, a sticker, and a decoration;

said base having two spaced apart tabs outward of said plate proximate said column, wherein each of said tabs is adapted to retain a smart phone;

said base having a bench of a cooperative shape to the cross section of said column, said bench being offset from said plate and parallel to a tangent upon said plate;

a round shade connecting to said column, said shade having a diameter greater than that of said base, and a socket of a cooperative shape to the cross section of said column, and said shade extending over and outward from said base, wherein said column connects to said bench and said column then connects to said socket thus said shade overhangs beyond said base;

said socket of said shade having a notch, said notch admitting said another second tube proximate said header;

said bench having a tab outwardly from said plate with a lower portion and an upper portion engaging corresponding openings in said wall of said column opposite said footer;

said socket having a tab towards said with a lower portion and an upper portion engaging corresponding openings in said wall of said column opposite said header;

wherein said column releasably connects to said bench and to said column;

said column having a compartment therein within said footer, said header, and said wall, said compartment is adapted to receive a smart phone;

said column proximate said footer solely connecting to said bench;

said column proximate said header solely connecting to said socket;

wherein said device is adapted to a user assembling it one way only;

said shade having a truncated convex shape extending from a rim inwardly and upwardly from said rim to a flat head centered upon said shade;

said truncated convex shape of said shade forming a hill spanning from said rim to said head;

a plurality of slotted cylinders depending from said hill and inward from said rim, each of said slotted cylinders having a lengthwise slot, and wherein each of said slotted cylinders is adapted to receive a bead from a bead string; and wherein said head is adapted to receive one of a label, a sticker, and a decoration.

10. The device for holding a beverage container and a smart phone under shade of claim 9 further comprising:

said door being transparent; and said plurality of slotted cylinders numbering twenty four.

* * * * *